US008870340B2

(12) United States Patent
Boland et al.

(10) Patent No.: US 8,870,340 B2
(45) Date of Patent: Oct. 28, 2014

(54) DYNAMIC DROP REDIRECTION FOR DROP ON DEMAND PRINTING

(71) Applicants: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(72) Inventors: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 13/781,237

(22) Filed: Feb. 28, 2013

(65) Prior Publication Data

US 2014/0240392 A1 Aug. 28, 2014

(51) Int. Cl.
*B41J 2/165* (2006.01)
*B41J 2/07* (2006.01)

(52) U.S. Cl.
CPC ..... *B41J 2/07* (2013.01)
USPC ..... 347/23

(58) Field of Classification Search
CPC ..... B41J 2/1707
See application file for complete search history.

(56) References Cited

U.S. PATENT DOCUMENTS

| | | | | |
|---|---|---|---|---|
| 4,175,266 | A * | 11/1979 | Nakano et al. | 347/77 |
| 6,808,246 | B2 | 10/2004 | Long | |
| 7,431,420 | B2 * | 10/2008 | Inoue | 347/23 |
| 7,543,923 | B2 | 6/2009 | McNestry | |
| 7,600,852 | B2 | 10/2009 | Brown et al. | |
| 7,621,616 | B2 | 11/2009 | Mitani et al. | |
| 8,070,277 | B2 | 12/2011 | Phillips et al. | |
| 8,128,196 | B2 | 3/2012 | Garbacz et al. | |
| 8,240,813 | B2 | 8/2012 | Lu et al. | |
| 2006/0055747 | A1 * | 3/2006 | Steiner | 347/82 |
| 2010/0149238 | A1 * | 6/2010 | Garbacz et al. | 347/10 |
| 2012/0026225 | A1 | 2/2012 | Mataki | |
| 2012/0287196 | A1 | 11/2012 | Boland et al. | |
| 2012/0306971 | A1 | 12/2012 | Kobashi et al. | |

OTHER PUBLICATIONS

Brady, M.J., Kuhn, L., Lane, R. et al. (Sep. 1975). Self purging deflector gutter for ink jet arrays. IBM TDB. Retrieved from http://ip.com/IPCOM/000084148.

* cited by examiner

*Primary Examiner* — Stephen Meier
*Assistant Examiner* — Renee I Wilson
(74) *Attorney, Agent, or Firm* — Duft Bornsen & Fettig LLP

(57) ABSTRACT

Systems and methods selectively remove flush drops from a plurality of ink drops ejected by a print engine when printing data for a print job. One embodiment comprises a control system of a printing system. The control system receives a flush pattern for flushing an ink jet print engine of the printing system, and receives a sheetside bitmap for printing to a print medium. The control system merges the flush pattern and the sheetside bitmap to generate a composite sheetside bitmap. The control system directs the print engine to eject a plurality of ink drops toward the print medium based on the composite sheetside bitmap, and identifies a subset of the ink drops based on the flush pattern. The control system then directs a drop deflection system of the printing system to selectively prevent the subset of ink drops from impinging the print medium.

18 Claims, 5 Drawing Sheets

DYNAMIC DROP REDIRECTION FOR DROP ON DEMAND PRINTING

FIELD OF THE INVENTION

The invention relates to the field of printing systems.

BACKGROUND

Businesses or other entities having a need for volume printing typically purchase a production printer. A production printer is a high-speed printer used for volume printing, such as 100 pages per minute or more. The production printers are typically continuous-form printers that print on paper or some other printable medium that is stored on large rolls.

A production printer typically includes a localized print controller that controls the overall operation of the printing system, a print engine (sometimes referred to as an "imaging engine" or as a "marking engine"), and a dryer. The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. The printhead array is formed from multiple printheads that are spaced in series along a particular width so that printing may occur across the width of the medium. The dryer is used to heat the medium and ink to dry the ink onto the medium.

For drop on demand print engines, drops of ink are ejected as needed to mark the medium with ink. During times of inactivity, ink within the nozzles of the print engine can begin to dry, which may clog or otherwise disturb the flow pattern when the nozzles resume ejecting ink drops. Thus, algorithms are designed to generate flush patterns to eject ink drops through the nozzles of the print engines to prevent this from occurring. This activity occurs during the actual job printing process, as nozzles may vary in activity during the printing process. The algorithms may utilize various criteria for generating flush patterns while printing the job, such as the amount of time one or more of the ink jet nozzles has been inactive, etc. The flush patterns may be printed onto non-used portions of the medium as a line or other pattern, or may be dispersed within portions of the medium that are marked based on print data for the job. However, it may not be desirable or possible to reserve blank portions of the medium for printing the flush patterns during printing of the job. Further, printing the flush pattern within the printed data for the job may reduce the quality of the printed output for the data.

SUMMARY

Embodiments described herein provide for selectively removing flush drops from a plurality of ink drops ejected by a print engine when printing data for a print job. Flush patterns are merged with the print data for the job, and the merged data is utilized by the print engine during the printing process to eject ink drops towards a media. The flush drops that are the result of the flush pattern are then selectively removed from the ejected ink drops to prevent the flush drops from impinging or otherwise marking the medium during the printing process. The selective removal of the flush drops allows for a concurrent flush and print activity that eliminates the dispersal of flush drops within the printed data of the job. Further, the selective removal of the flush drops allows for a concurrent flush and print activity that eliminates the reservation of blank portions of the medium specifically for printing flush patterns. This improves the quality of the printed output for the job.

One embodiment is a control system of a printing system. The control system is operable to receive a flush pattern for flushing an ink jet print engine of the printing system. The control system is further operable to receive a sheetside bitmap for printing to a print medium, and to merge the flush pattern and the sheetside bitmap to generate a composite sheetside bitmap. The control system is further operable to direct the print engine to eject a plurality of ink drops toward the print medium based on the composite sheetside bitmap, and to identify a subset of the ink drops based on the flush pattern. The control system is further operable to direct a drop deflection system of the printing system to selectively prevent the subset of ink drops from impinging the print medium.

Another embodiment is a method for selectively removing flush drops from a plurality of ink drops ejected by a print engine when printing data for a print job. The method comprises receiving a flush pattern for flushing an ink jet print engine of a printing system, and receiving a sheetside bitmap for printing to a print medium. The method further comprises merging the flush pattern and the sheetside bitmap to generate a composite sheetside bitmap, and directing the print engine to eject a plurality of ink drops toward the print medium based on the composite sheetside bitmap. The method further comprises identifying a subset of the ink drops based on the flush pattern, and directing a drop deflection system of the printing system to selectively prevent the subset of ink drops from impinging the print medium.

Another embodiment is a non-transitory computer readable medium embodying programmed instructions executable by a processor of a printing system. The instructions direct the processor to receive a flush pattern for flushing an ink jet print engine of a printing system, and to receive a sheetside bitmap for printing to a print medium. The instructions further direct the processor to merge the flush pattern and the sheetside bitmap to generate a composite sheetside bitmap, and to direct the print engine to eject a plurality of ink drops toward the print medium based on the composite sheetside bitmap. The instructions further direct the processor to identify a subset of the ink drops based on the flush pattern, and to direct a drop deflection system of the printing system to selectively prevent the subset of ink drops from impinging the print medium.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
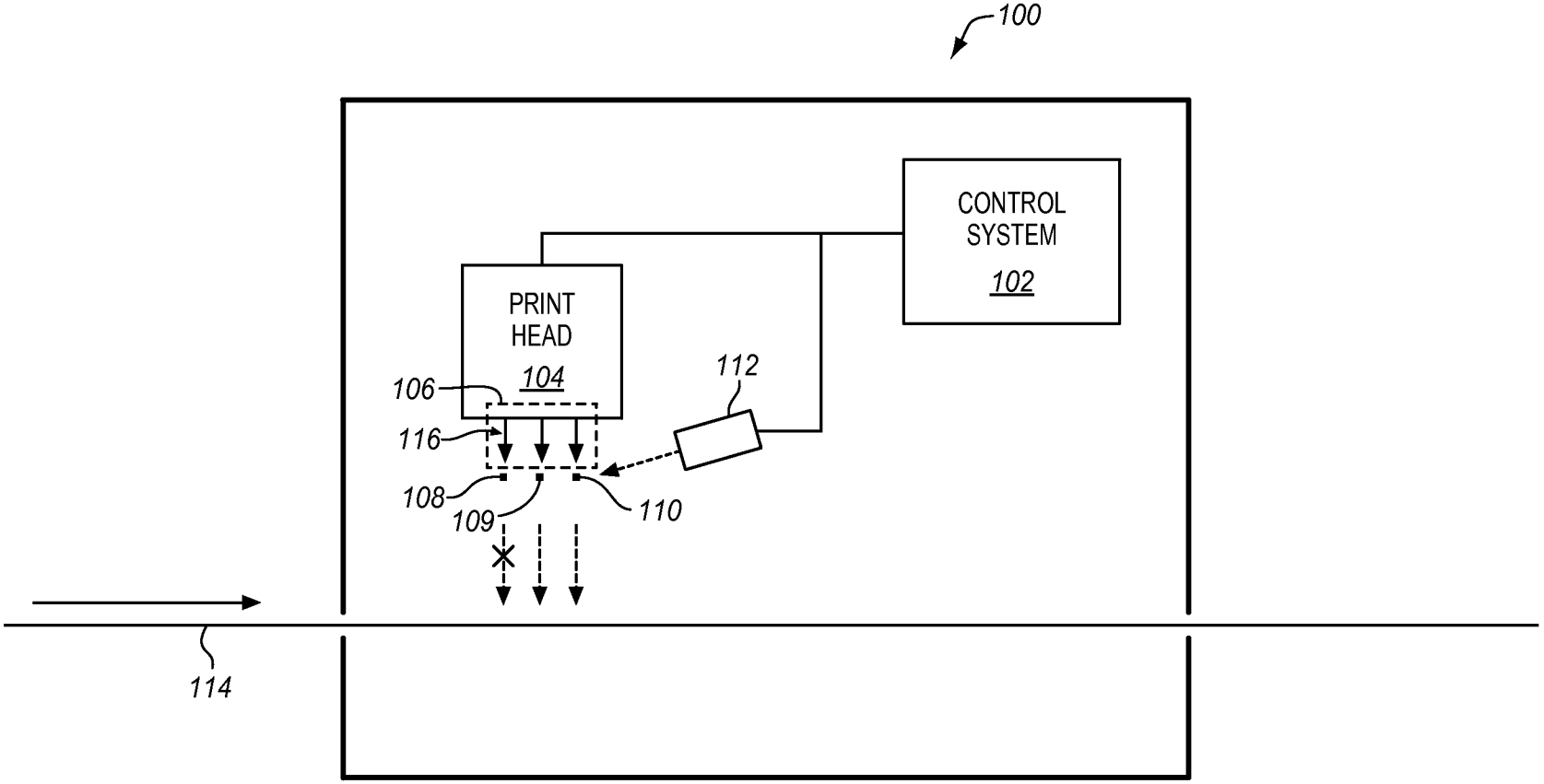
FIG. 1 is a block diagram of a printing system in an exemplary embodiment.

FIG. 1 is a block diagram of a printing system 100 in an exemplary embodiment. In this embodiment, printing system 100 includes a control system 102, a print engine 104 (e.g., a drop on demand ink jet print engine), and a drop deflection system 112. A web of print media 114 traverses a media path through printing system 100 in the direction indicated by the arrow in FIG. 1. During the printing process, media 114 travels along the media path proximate to print engine 104 for marking with a wet colorant (e.g., aqueous ink) by a plurality of ink jet nozzles 106. Media 114, now wet with the colorant, continues along the media path downstream of printing system 100 and has heat applied to media 114 by a drying system (not shown) to affix the colorant to media 114. Media 114 then continues along the media path downstream of the dryer where a number of post-processing activities may occur (e.g., cutting, stapling, folding, binding, mailing, etc.).

One problem with prior printing systems, such as drop on demand printing systems, is that during times of inactivity the ink within the nozzles of the print engine can begin to dry. This may clog or otherwise disturb the flow pattern when the nozzles resume ejecting ink drops. In prior printing systems, flushing patterns are applied to a print engine to generate flush drops at the nozzles, which strike the print media either on non-printed portions of the print media or within areas of the printed portions of the media, neither of which is preferable.

In this embodiment, control system 102 has been enhanced to coordinate the selective removal of flush drops from a plurality of drops ejected during the process of printing data for a job. The flush drops in this embodiment are not ejected separately from the actual print data utilized in printing the job, but instead are merged within the print data for the job and are selectively removed as the merged print data is printed. Because the flush drops are prevented from striking the surface of media 114, the flush drops do not become part of the printed output of the print job, either as separate non-data regions that are reserved for the flush drops or as integrated within the print data for the job. This allows for a substantially concurrent flush and print process to occur, which improves the quality of the printed output for the job.

In general, control system 102 comprises any system, component, or device that is able to directly or indirectly prevent one or more ink drops 108-110 from impinging or otherwise marking media 114. Control system 102 may be included as part of a print controller (not shown) for printing system 110, as part of a printhead controller (also not shown) for print engine 104, or some combination thereof as a matter of design choice.

To coordinate the activity of removing the flush drops, control system 102 directs drop deflection system 112 to selectively deflect and/or prevent one or more of a plurality of ink drops 108-110 ejected by nozzles 106 from impinging media 114. In some embodiments, drop deflection system 112 may utilize air jets, vacuum, electrostatic fields, or some combination thereof to deflect one or more of ink drops 108-110 into a drop catcher (not shown), thus preventing the deflected drop from impinging or otherwise marking media 114. In other embodiments, drop deflection system 112 may utilize a high power laser to in effect, evaporate one or more of ink drops 108-110 thus preventing the evaporated drop(s) from impinging or otherwise marking media 114.

In general, drop deflection system 112 comprises any system, component, or device that is operable to prevent or more of ink drops 108-110 that have been ejected by nozzles 106 from impinging media 114.

Consider an example whereby a print operator is tasked with printing a job at printing system 100, which has been enhanced to selectively prevent flush drops that have been concurrently ejected along with data drops from impinging media 114. The print operator may specifically select printing system 100 based on the customer for the job and/or the specific characteristics of the job. For example, the customer may object to having flush patterns printed to regions on media 114 due to print quality concerns, or the job may be configured such that there are little or no non-printed regions that may be utilized for printing flush patterns. The print operator initiates printing of the job, which causes media 114 to traverse along the media path through printing system 100 in the direction indicated by the arrow in FIG. 1.

Figure 2:
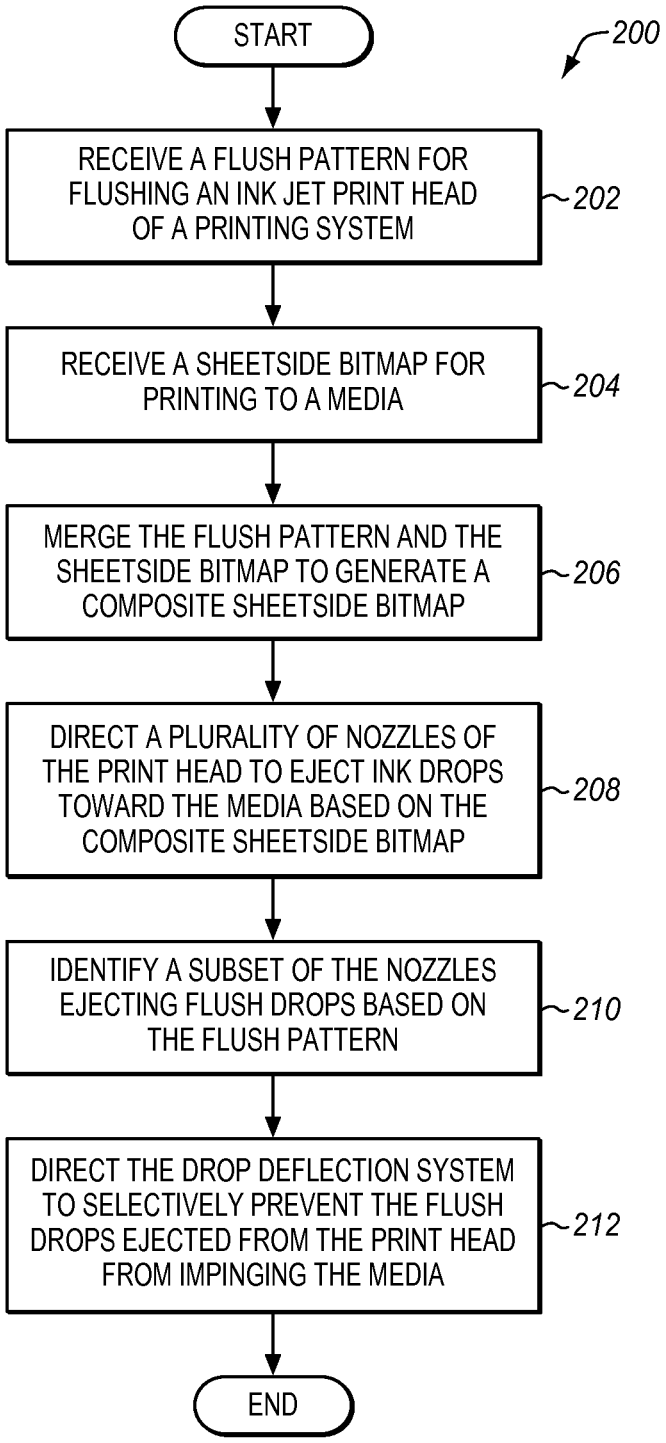
FIG. 2 is a flowchart of a method for selectively removing flush drops from a plurality of ink drops ejected by a print engine when printing data for a print job in an exemplary embodiment.

FIG. 2 is a flowchart illustrating a method for selectively removing flush drops from a plurality of ink drops ejected by a print engine when printing data for a print job in an exemplary embodiment. The steps of method 200 will be described with reference to printing system 100 of FIG. 1, but those skilled in the art will appreciate that method 200 may be performed in other systems. The steps of the flowchart(s) described herein are not all inclusive and may include other steps not shown. The steps described herein may also be performed in an alternative order.

Figure 3:
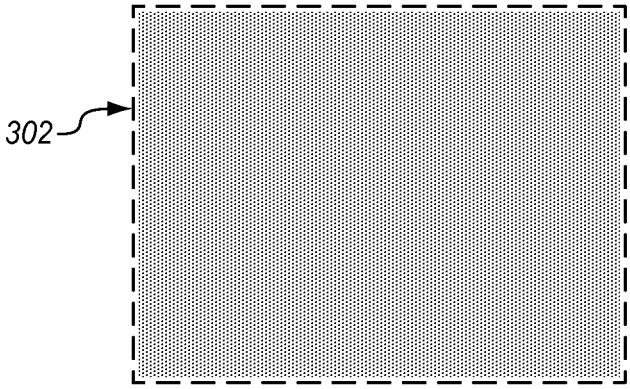
FIG. 3 illustrates one example of a flush pattern.

In step 202, control system 102 receives a flush pattern for flushing print engine 104. FIG. 3 illustrates one example of a flush pattern 302. Although FIG. 3 illustrates a specific configuration for a flush pattern, the configuration illustrated in FIG. 3 is merely included for purposes of discussion. Thus, one skilled in the art will recognize that other configurations for flush patterns will exist.

The flush pattern may be generated by a print controller, a print head controller, or some other system based on a flushing algorithm. The flushing algorithm may, for example, analyze the ink ejection activity of nozzles 106 of print engine 104, and generate a flushing pattern to flush ink drops from one or more nozzles 106. Generally, this flushing activity is performed while actively printing a job. Thus, it may not be sufficient to simply wait until the job is completely printed prior to flushing print engine 104.

Figure 4:
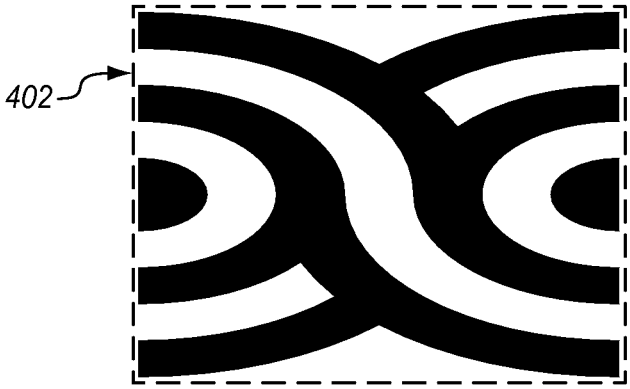
FIG. 4 illustrates one example of a sheetside bitmap.

In step 204, control system 102 receives sheetside bitmap for printing to media 114. FIG. 4 illustrates one example of a sheetside bitmap 402 in an exemplary embodiment. Although FIG. 4 illustrates a specific configuration for a sheetside bitmap, the configuration illustrated in FIG. 4 is merely included for purposes of discussion. Thus, one skilled in the art will recognize that other configurations for sheetside bitmaps will exist.

Generally, sheetside bitmaps are generated during the printing process for a print job. Sheetside bitmaps may include one or more logical pages, depending on the n-up configuration in the job. For example, in a 4-up printing configuration, logical pages for the job are rasterized (e.g., by a rasterizer or other system, not shown) and arranged 4 to a sheetside for printing to a printable medium. During the printing process, a plurality of sheetside bitmaps are assembled and provided to a marking engine, which marks the printable medium based on the sheetside bitmaps in order to print the job.

Figure 5:
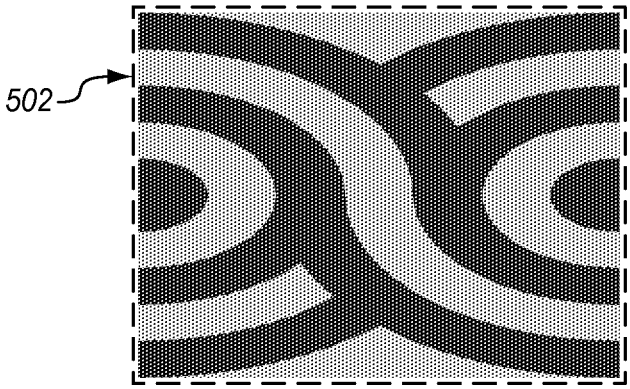
FIG. 5 is one example of a composite sheetside bitmap.

In step 206, control system 102 merges the flush pattern (e.g., flush pattern 302) and the sheetside bitmap (e.g., sheetside bitmap 402) to generate a composite sheetside bitmap. FIG. 5 illustrates one example of a composite sheetside bitmap 502. Although FIG. 5 illustrates a specific configuration for a composite sheetside bitmap, the configuration illustrated in FIG. 5 is merely included for purposes of discussion. Thus, one skilled in the art will recognize that other configurations for composite sheetside bitmaps will exist.

In step 208, control system 102 directs print engine 104 to eject plurality of ink drops 108-110 towards media 114 based on the composite sheetside bitmap (e.g., composite sheetside bitmap 502). As discussed previously, ink for flush pattern data and ink for print data for a job are ejected substantially concurrently by print engine 104 during the flushing process for print engine 104. As the composite sheetside bitmap includes both the flush pattern and the sheetside bitmap data corresponding to a portion of print data for a job, ink drops 108-110 ejected by print engine 104 include both flush drops based on the flush pattern and ink drops based on the sheetside bitmap.

In step 210, control system 102 identifies a subset of ink drops 108-110 based on the flush pattern. Control system 102 may compare the flush pattern with the composite sheetside bitmap to in effect, identify which of ink drops 108-110 are flush drops. For example, control system 102 may identify drop 108 as a flush drop based on the flush pattern.

In step 210, control system 102 directs drop deflection system 112 to selectively prevent the subset of ink drops from impinging media 114. For instance, if control system 102 identifies drop 108 as a flush drop, then control system directs deflection system 112 to deflect, evaporate, etc., drop 108, thus preventing drop 108 from impinging or otherwise marking media 114. In some embodiments, control system 102 calculates a delay between directing print engine 104 to eject ink and a proximity of drops 108-110 to an active region of drop deflection system 112. For instance, drops 108-110 may be ejected at different velocities, etc., by print engine 104. Further, drop deflection system 112 may operate differently depending on the deflection methods. Laser ablation of one or more of ink drops 108-110 may be nearly instantaneous, while air, vacuum, or some other methods may be slower.

Figure 6:
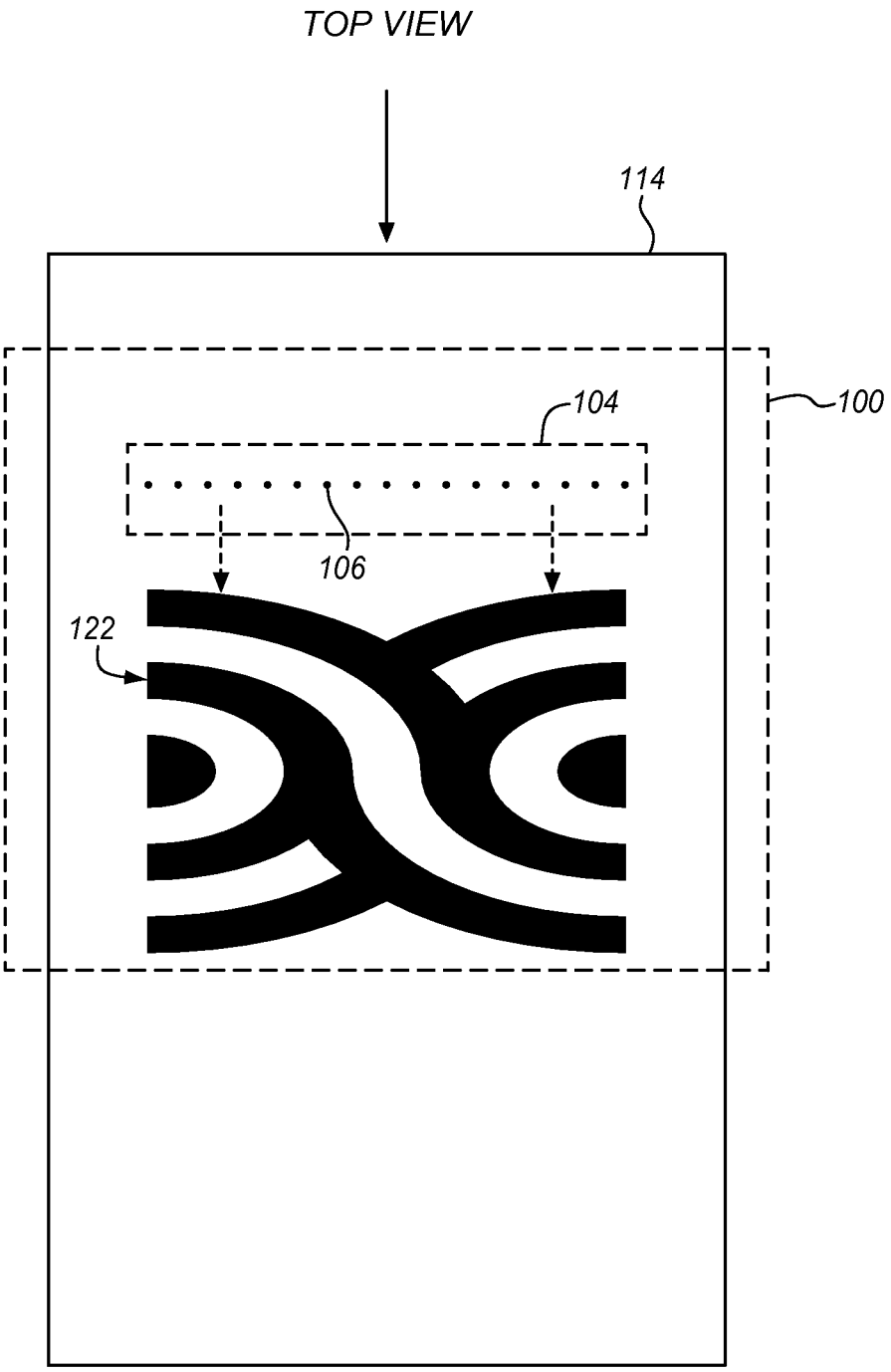
FIG. 6 is a block diagram of a top view of a portion of the printing system of FIG. 1 in an exemplary embodiment.

FIG. 6 is a block diagram of a top view of a portion of printing system 100 in an exemplary embodiment. In this view, print engine 104 has utilized one or more nozzles 106 to eject ink towards media 114 based on a composite sheetside bitmap (e.g., composite sheetside bitmap 502). However, as control system 102 (not shown in this view) has directed drop deflection system 112 (also not shown in this view) to selectively prevent the identified flush ink drops from impinging media 114, the result is the printed output for the sheetside bitmap (e.g., image 122). By preventing the flush drop(s) from impinging media 114, printing system 100 is able to concurrently perform a flushing process for print engine 104 and mark media 114 with print data for the job. Further, because the flushing drops do not mark the media, the flushing process may be performed more frequently. This improves the quality of the printing process over prior printing systems.

Figure 7:
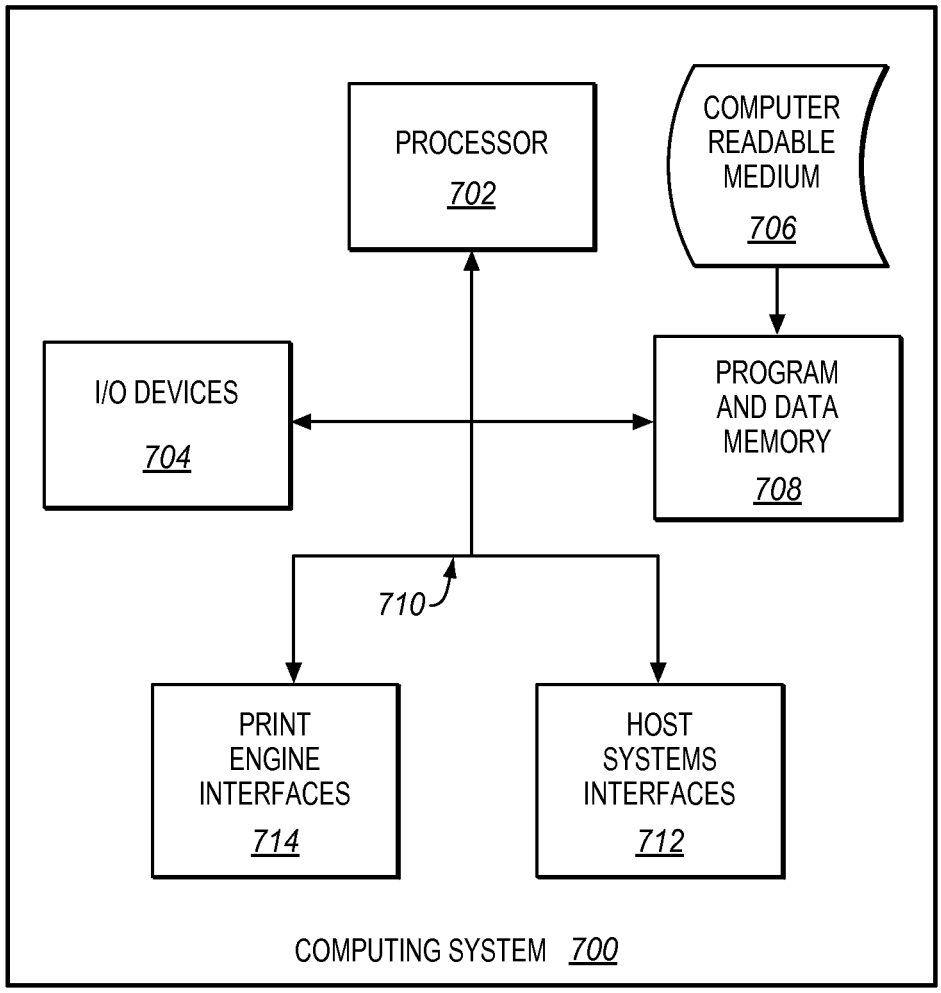
FIG. 7 is a block diagram of a processing system operable to execute a computer readable medium embodying programmed instructions to perform desired functions in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 7 illustrates a computing system 700 in which a computer readable medium may provide instructions for performing the method of FIG. 2 in an exemplary embodiment.

Furthermore, the invention can take the form of a computer program product accessible from a computer-usable or computer-readable medium 706 providing program code for use by or in connection with a computer or any instruction execution system. For the purposes of this description, a computer-usable or computer readable medium 706 can be any apparatus that can contain, store, communicate, or transport the program for use by or in connection with the instruction execution system, apparatus, or device.

The medium 706 can be an electronic, magnetic, optical, electromagnetic, infrared, or semiconductor system (or apparatus or device) or a propagation medium. Examples of a computer-readable medium 706 include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include one or more processors 702 coupled directly or indirectly to memory 708 through a system bus 710. The memory 708 can include local memory employed during actual execution of the program code, bulk storage, and cache memories which provide temporary storage of at least some program code in order to reduce the number of times code is retrieved from bulk storage during execution.

Input/output or I/O devices 704 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 712, or remote printers or storage devices through intervening private or public networks. Modems, cable modem and Ethernet cards are just a few of the currently available types of network adapters. Computing system 700 further includes print engine interfaces 714.

Although specific embodiments were described herein, the scope of the invention is not limited to those specific embodiments. The scope of the invention is defined by the following claims and any equivalents thereof.

We claim:

1. An apparatus comprising:

a control system of a printing system, the control system operable to receive a flush pattern for flushing an ink jet print engine of the printing system, to receive a sheetside bitmap for printing to a print medium, and to merge the flush pattern and the sheetside bitmap to generate a composite sheetside bitmap;

the control system is further operable to direct the print engine to eject a plurality of ink drops toward the print medium based on the composite sheetside bitmap, to identify a subset of the ink drops based on the flush pattern, and to direct a drop deflection system of the printing system to selectively prevent the subset of ink drops from impinging the print medium.

2. The apparatus of claim 1 wherein:

the print engine is a drop on demand ink jet print engine; and the control system is further operable to identify a delay between directing the print engine to eject ink and a proximity of the ejected ink to a deflection region of the drop deflection system, and to direct the drop deflection system to selectively prevent the subset of ink drops from impinging the print medium based on the delay.

3. The apparatus of claim 2 wherein:

the control system is further operable to direct the drop deflection system to generate a transitory air flow within the deflection region to prevent the subset of ink drops from impinging the print medium.

4. The apparatus of claim 2 wherein:

the control system is further operable to direct the drop deflection system to generate a transitory vacuum within the deflection region to prevent the subset of ink drops from impinging the print medium.

5. The apparatus of claim 2 wherein:

the control system is further operable to direct the drop deflection system to impart an electric charge onto the subset of ink drops, and to generate a transitory electrostatic field within the deflection region to prevent the subset of ink drops from impinging the print medium.

6. The apparatus of claim 2 wherein:

the control system is further operable to direct the drop deflection system to evaporate the subset of ink drops within the deflection region to prevent the subset of ink drops from impinging the print medium.

7. A method comprising:

receiving a flush pattern for flushing an ink jet print engine of a printing system;

receiving a sheetside bitmap for printing to a print medium;

merging the flush pattern and the sheetside bitmap to generate a composite sheetside bitmap;

directing the print engine to eject a plurality of ink drops toward the print medium based on the composite sheetside bitmap;

identifying a subset of the ink drops based on the flush pattern; and directing a drop deflection system of the printing system to selectively prevent the subset of ink drops from impinging the print medium.

8. The method of claim 7 wherein:

the print engine is a drop on demand ink jet print engine; and the method further comprises:

identifying a delay between directing the print engine to eject ink and a proximity of the ejected ink to a deflection region of the drop deflection system; and the step of directing further comprises:

directing the drop deflection system to selectively prevent the subset of ink drops from impinging the print medium based on the delay.

9. The method of claim 8 wherein:

the step of directing further comprises:

directing the drop deflection system to generate a transitory air flow within the deflection region to prevent the subset of ink drops from impinging the print medium.

10. The method of claim 8 wherein:

the step of directing further comprises:

directing the drop deflection system to generate a transitory vacuum within the deflection region to prevent the subset of ink drops from impinging the print medium.

11. The method of claim 8 wherein:

the step of directing further comprises:

directing the drop deflection system to impart an electric charge onto the subset of ink drops, and to generate a transitory electrostatic field within the deflection region to prevent the subset of ink drops from impinging the print medium.

12. The method of claim 8 wherein:

the step of directing further comprises:

directing the drop deflection system to evaporate the subset of ink drops within the deflection region to prevent the subset of ink drops from impinging the print medium.

13. A non-transitory computer readable medium embodying programmed instructions executable by a processor of a printing system, the instructions directing the processor to:

receive a flush pattern for flushing an ink jet print engine of the printing system;

receive a sheetside bitmap for printing to a print medium;

merge the flush pattern and the sheetside bitmap to generate a composite sheetside bitmap;

direct the print engine to eject a plurality of ink drops toward the print medium based on the composite sheetside bitmap;

identify a subset of the ink drops based on the flush pattern; and direct a drop deflection system of the printing system to selectively prevent the subset of ink drops from impinging the print medium.

14. The medium of claim 13 wherein:

the print engine is a drop on demand ink jet print engine; and the instructions further direct the processor to:

identify a delay between directing the print engine to eject ink and a proximity of the ejected ink to a deflection region of the drop deflection system; and instructions to direct the drop deflection system further comprise instructions to:

direct the drop deflection system to selectively prevent the subset of ink drops from impinging the print medium based on the delay.

15. The medium of claim 14 wherein:

instructions to direct the drop deflection system further comprise instructions to:

direct the drop deflection system to generate a transitory air flow within the deflection region to prevent the subset of ink drops from impinging the print medium.

16. The medium of claim 14 wherein:

instructions to direct the drop deflection system further comprise instructions to:

direct the drop deflection system to generate a transitory vacuum within the deflection region to prevent the subset of ink drops from impinging the print medium.

17. The medium of claim 14 wherein:

instructions to direct the drop deflection system further comprise instructions to:

direct the drop deflection system to impart an electric charge onto the subset of ink drops, and to generate a transitory electrostatic field within the deflection region to prevent the subset of ink drops from impinging the print medium.

18. The medium of claim 14 wherein:

instructions to direct the drop deflection system further comprise instructions to:

direct the drop deflection system to evaporate the subset of ink drops within the deflection region to prevent the subset of ink drops from impinging the print medium.

* * * * *